United States Patent [19]

Chia

[11] 4,000,008

[45] Dec. 28, 1976

[54] METHOD OF TREATING CAST ALUMINUM METAL TO LOWER THE RECRYSTALLIZATION TEMPERATURE

[75] Inventor: Enrique Henry Chia, Carroll County, Ga.

[73] Assignee: Southwire Company, Carrollton, Ga.

[22] Filed: Feb. 3, 1975

[21] Appl. No.: 546,353

[52] U.S. Cl. ..... 148/2; 29/193; 75/138; 148/11.5 A; 148/12.7 R; 148/159; 164/76

[51] Int. Cl.[2] ..... B22D 25/00; C21D 1/04

[58] Field of Search ..... 148/11.5 A, 2, 159, 148/32, 32.5, 12.7; 75/138; 164/76; 29/193

[56] References Cited

UNITED STATES PATENTS

| | | | |
|---|---|---|---|
| 3,078,191 | 2/1963 | Maeda | 148/11.5 |
| 3,234,054 | 2/1966 | Sperry | 148/11.5 A |
| 3,647,565 | 3/1972 | Schoerner | 148/2 |
| 3,674,569 | 7/1972 | Pryor et al. | 148/11.5 A |
| 3,807,969 | 4/1974 | Schoerner et al. | 148/11.5 A |
| 3,827,917 | 8/1974 | Zeigler et al. | 148/11.5 A |
| 3,830,635 | 8/1974 | Chia et al. | 148/2 |

OTHER PUBLICATIONS

Sachs, G. et al; *Practical Metallurgy*, Cleveland (ASM), 1951, pp. 123–129.

Harrington, R; *Effect of Single . . . Metals on Recrystallization . . . of Pure Aluminum*, in *Trans. ASM*, 41, 1949, pp. 443–459.

*Primary Examiner*—Walter R. Satterfield

*Attorney, Agent, or Firm*—Van C. Wilks; Herbert M. Hanegan; Stanley L. Tate

[57] ABSTRACT

A method of treating metal stock to lower the recrystallization temperature thereof comprising casting the metal into a continuous bar in a moving mold formed by a groove in the periphery of a casting wheel and an endless belt lying adjacent the groove along a portion of the periphery of the wheel, hot-working the bar substantially immediately after casting while the bar is in substantially that condition as cast by rolling the bar in closed roll passes to obtain a continuous metal rod, and allowing the rod to cool from the elevated rolling temperature to about 400° F in a minimum of 30 seconds and from about 400° F to ambient temperature at a maximum cooling rate of 300° F per minute. A metal rod processed in this fashion has a lower recrystallization temperature than one which is quenched or quickly cooled after rolling.

18 Claims, No Drawings

METHOD OF TREATING CAST ALUMINUM METAL TO LOWER THE RECRYSTALLIZATION TEMPERATURE

FIELD OF THE INVENTION

This invention relates to a method of treating metal stock to lower the recrystallization temperature thereof. A metal product having a lowered recrystallization temperature can be annealed at temperatures lower than conventionally processed metal products having higher recrystallization temperatures.

DESCRIPTION OF THE PRIOR ART

The prior art discloses that metals such as aluminum and aluminum alloys processed by continuous casting and rolling methods are quenched or quickly cooled to room temperature rapidly after rolling and prior to coiling. The rapid cooling during casting prevents total precipitation and precipitates that do occur are very small. The large deformation of the cast bar that occurs during rolling tends to break up these small precipitates further decreasing their size as well as distributing the fragmented precipitate particles so that they become effective obstacles to the movement of cell walls and dislocations. Consequently, these small precipitates hinder recrystallization. Quenching or rapid cooling before further deformation from the rod form to wire form, as in drawing, maintains the fine precipitate particle size which will increase the recrystallization temperature by inhibiting cell growth. Known prior art methods do not disclose the present process for lowering the recrystallization temperature of a metal product by allowing the rod to cool from the elevated rolling temperature to about 400° F in a minimum of 30 seconds and from about 400° F to ambient temperature at a maximum cooling rate of 300° F per minute, thereby lowering the annealing temperature of the product.

SUMMARY OF THE INVENTION

It is therefore an object of this invention to provide a method of treating metal stock to lower the recrystallization temperature thereof.

It is a further object of the present invention to provide a novel method of treating continuously cast and rolled aluminum and aluminum alloys to lower the recrystallization temperature and thereby decrease the temperature necessary to anneal the product to the desired annealing state.

Other objects and advantages of the present invention will become apparent from the following description.

DESCRIPTION OF THE PREFERRED EMBODIMENTS

This invention is concerned with a method of treating metal stock to lower the recrystallization temperature thereof comprising the steps of casting the metal into a continuous bar in a moving mold formed by a groove in the periphery of a casting wheel and an endless belt lying adjacent the groove along a portion of the periphery of the wheel, hot-working the bar substantially immediately after casting while the bar is in substantially that condition as cast by rolling the bar in closed roll passes to obtain a continuous metal rod, and allowing the rod to cool from the elevated rolling temperature to about 400° F in a minimum of 30 seconds and from about 400° F to ambient temperature at a maximum cooling rate of 300° F per minute.

Advantageously, the metal stock used in the method of this invention is either electrical conductor grade aluminum or an aluminum alloy. If the metal stock to be used is an aluminum alloy preferably the alloying elements added to aluminum having associated trace elements are selected from the group consisting of iron, cobalt, nickel, silicon, copper, magnesium and rare earths. An aluminum alloy containing two or more of these alloying elements may be especially preferred where certain mechanical and/or electrical properties are desired.

In accordance with this invention, the following elements in the ranges given may be alloyed with aluminum having associated trace elements:

The method of this invention may be practiced using an alloy of aluminum having associated trace elements with from about 0.10 to about 1.20 weight percent iron and up to about 1.00 weight percent silicon. Advantageously this alloy contains from about 0.30 to about 0.95 weight percent iron and from about 0.01 to about 0.15 weight percent silicon. When using the method of this invention and an alloy of iron and silicon with aluminum the aluminum advantageously has no more than about 0.05 weight percent each of associated trace elements. For some uses, it is preferable that this alloy contain from about 0.45 to about 0.95 weight percent iron and from about 0.01 to about 0.15 weight percent silicon. For uses where a relatively high tensile strength is desired it is advantageous when using the method of this invention and an alloy of iron or iron and silicon with aluminum that from about 0.01 to about 0.60 weight percent magnesium be added to the alloy.

The method of this invention may also be practiced using an alloy of aluminum having associated trace elements and from 0.20 to about 1.60 weight percent cobalt and from about 0.30 to about 1.30 weight percent iron or nickel. For some end product uses it may be advantageous to add up to about 0.40 weight percent magnesium and up to about 0.40 weight percent copper to this alloy.

Another alloy advantageously used when practicing the method of this invention is alloying from about 0.20 to about 1.60 weight percent nickel and from about 0.30 to about 1.30 weight percent iron with aluminum having associated trace elements. Advantageously, for some end product uses up to about 0.40 weight percent magnesium and up to about 0.40 weight percent copper may be added to this alloy.

Another preferred embodiment of practicing the method of this invention is alloying aluminum with associated trace elements with from about 0.55 to about 0.95 weight percent cobalt or nickel. For some end product uses it may be advantageous to add to this alloy about 0.001 to about 1.00 weight percent magnesium.

The method of this invention may also be practiced using alloys of aluminum with associated trace elements having relatively large amounts of alloying elements such as from about 0.35 to about 4.00 weight percent cobalt or nickel and from about 0.10 to about 2.50 weight percent of an additional alloying element selected from the group consisting of iron, copper, silicon, zirconium, niobium, tantalum, yttrium, scandium, thorium and rare earth metals.

When practicing the method of this invention using aluminum or aluminum alloys as the metal stock to be treated to lower the recrystallization temperature thereof, the temperature of the metal rod as it exits the rod mill should be from about 500° F to about 850° F. Preferably the temperature of the rod as it exits the rolling mill is from about 550° F to about 750° F. The rod is not quenched or cooled quickly to room temperature when it exits the rolling mill as prior art methods disclose, but is allowed to cool from the elevated rolling temperature to about 400° F in a minimum of 30 seconds and from about 400° F to ambient temperature at a maximum cooling rate of 300° F per minute. Prior art quenching lowers the temperature of the rod from the rolling mill exit temperature of about 700° F to about 100° F in 2 seconds, a cooling rate of approximately 300° F per second. Preferably the rod is cooled from the elevated rolling temperature to ambient temperature in the absence of application of any quenching medium. If the rod is partially quenched by application of a cooling solution as it exits the rolling mill it must not be cooled to less than about 400° F in less than 30 seconds and must not be cooled from about 400° F to ambient temperature at a cooling rate greater than 300° F per minute. The rod formed by using the method of this invention may be drawn with no preliminary or intermediate anneals to form wire and if desired then annealed or partially annealed at a temperature of below about 500° F. The cooled rod may also be drawn with no preliminary or intermediate anneals to form wire and the wire simultaneously annealed and enameled with an electrolytic resin at a temperature of below about 500° F.

The rod product formed in accordance with the method of this invention may be further processed by applying a thin annular sheath of cladding material around the entire periphery of said rod and bonding said sheath to said rod to produce a clad rod suitable for subsequent drawing into wire without the necessity of subsequent heat treating or metal cutting operations on said clad rod. Advantageously the cladding material used is copper or tin. Preferably the maximum temperature of the rod during the bonding step is less than about 500° F. One of the significant features of the present invention is that an aluminum or aluminum alloy rod which has been clad with copper can be annealed at a temperature of about 500° F to the desired annealing state because of the lowered recrystallization temperature of the rod. Conventionally processed aluminum or aluminum alloy clad products have to be annealed at a temperature above 525° F using conventional commercial annealing processes in order to achieve the necessary physical and mechanical properties. However, when a copper clad aluminum or aluminum alloy is subjected to temperature above 525° F the product will form a layer of brittle $Cu_2Al$ compound between the aluminum and the copper which will render the copper clad aluminum or aluminum alloy product unusable. The brittle compound $Cu_2Al$ does not form at temperatures below 500° F. Therefore, formation of this compound during the processing of copper clad aluminum, which is one of the shortcomings of the prior art processes, is overcome by practicing the method of this invention.

In the practice of this invention, two processes occur within the rod during slow cooling: static recovery and additional precipitation of impurity atoms. In static recovery the hot rolled substructure is changed by reduction of the disclocation density and by cell growth. Allowing the rod to remain at an elevated temperature for a longer length of time than in the prior art thermally activates the motion of dislocations by the known mechanisms of cross-slip and climb, which proceed in response to the internal stress fields of dislocation tangles. The simultaneous operation of cross-slip and climb leads to polygonization with the formation of subgrains as the dislocations inside the cells move to the cell walls. The subgrains then increase in size due to coalescence. During the slow cooling time additional precipitation of impurity atoms takes place. These fine precipitate particles can act as nucleation sites for reprecipitation, resulting in the formation of large, coarse precipitate particles. These precipitate particles will be fragmentized during cold drawing, but the resulting fragments will be larger than the corresponding particles in wire produced from conventionally quick cooled or quenched rod. Coarse precipitates increase the rate of isothermal recrystallization and lower the recrystallization temperature when they are present. The resulting lowered recrystallization temperature enables the wire to be annealed to the desired annealing state at a lower temperature than would be possible had the rod been quenched or rapidly cooled as it exited the rolling mill.

The aluminum or aluminum alloy products produced by the method of this invention are particularly well suited for use as electrical conductors.

One example of a continuous casting and rolling operation capable of producing continuous rod as specified in this application is as follows:

A continuous casting machine serves as a means for solidifyin g the molten aluminum or aluminum alloy metal to provide a cast bar that is conveyed in substantially the condition in which it solidified from the continuous casting machine to the rolling mill, which serves as a means for hot forming the cast bar into rod or another hot formed product in a manner which imparts substantial movement to the cast bar along a plurality of angularly disposed axes.

The continuous casting machine is of conventional casting wheel type having a casting wheel with a casting groove partially closed by an endless belt supported by the casting wheel and an idler pulley. The casting wheel and the endless belt cooperate to provide a mold into one end of which molten metal is poured to solidify and from the other end of which the cast bar is emitted in substantially that condition in which it solidified. The rolling mill is of conventional type having a plurality of roll stands arranged to hot form the cast bar by a series of deformations. The continuous casting machine and the rolling mill are positioned relative to each other so that the cast bar enters the rolling mill substantially immediately after solidification and in substantially that condition in which it solidified. In this condition, the cast bar is at a hot-forming temperature within the range of temperatures for hot-forming the cast bar at the initiation of hot-forming without heating between the casting machine and the rolling mill. In the event that it is desired to closely control the hot-forming temperature of the cast bar within the conventional range of hot-forming temperatures, means for adjusting the temperature of the cast bar may be placed between the continuous casting machine and the rolling mill without departing from the inventive concept disclosed herein.

The roll stands each include a plurality of rolls which engage the cast bar. The rolls of each roll stand may be two or more in number and arranged diametrically opposite from one another or arranged at equally spaced positions about the axis of movement of the cast bar through the rolling mill. The rolls of each roll stand of the rolling mill are rotated at a predetermined speed by a power means such as one or more electric motors and the casting wheel is rotated at a speed generally determined by its operating characteristics. The rolling mill serves to hot form the cast bar into a rod of a cross-sectional area substantially less than that of the cast bar as it entered the rolling mill.

The peripheral surfaces of the rolls of adjacent roll stands in the rolling mill change in configuration; that is, the cast bar is engaged by the rolls of successive roll stands with the surfaces of varying configuration, and from different directions. This varying surface engagement of the cast bar and the roll stands functions to knead or shape the metal in the cast bar in such a manner that it is worked at each roll stand and also to simultaneously reduce and change the cross-sectional area of the cast bar into that of the rod.

As each roll stand engages a cast bar, it is desirable that the cast bar be received with sufficient volume per unit of time at the roll stand for the cast bar to generally fill the space defined by the rolls of the roll stand so that the rolls will be effective to work the metal in the cast bar. However, it is also desirable that the space defined by the rolls of each roll stand will not be overfilled so that the cast bar will not be forced into the gaps between the rolls. Thus, it is desirable that the rod be fed toward each roll stand at a volume per unit of time which is sufficient to fill but not overfill the space defined by the rolls of the roll stand.

As the cast bar is received from the continuous casting machine, it usually has one large, flat surface corresponding to the surface of the endless band and inwardly tapered side surfaces corresponding to the shape of the groove in the casting wheel. As the cast bar is compressed by the rolls of the roll stand, the cast bar is deformed so that it generally takes the cross-sectional shape defined by the adjacent peripheries of the rolls of each roll stand.

Thus, it will be understood that with this apparatus, cast aluminum or aluminum alloy rod of an infinite number of different lengths is prepared by simultaneously casting of the molten metal and hot-forming or rolling the cast bar.

EXAMPLE

An aluminum alloy rod having the following composition: 0.60 weight percent iron, 0.07 weight percent silicon, 99.38 weight percent aluminum with associated trace elements was formed by continuously casting of a molten alloy metal into cast bar followed by rolling the bar into metal rod of 0.375 inch diameter. One portion (Sample No. 1) of the metal rod was then quenched and cooled to room temperature (between 80° – 100° F) in approximately 2 seconds. Another portion of the metal rod (Sample No. 2) was allowed to cool in ambient temperature air from the elevated rolling temperature to 400° F in 40 seconds and from 400° F to room temperature in 2 minutes.

The physical property of percent elongation is sensitive to changes in recrystallization of the product and indicates the state of anneal of the product. Both samples were cold drawn to 0.022 inch diameter wire and annealed for two hours at 475° F. The percent elongation (in ten inches) was then determined. Sample No. 1, which was quenched quickly from rolling temperature to room temperature, had a 0.20 percent elongation. Sample No. 2, which was not quenched after rolling but allowed to cool at ambient temperature, had a 27.6 percent elongation.

This invention has been described in detail with particular reference to the preferred embodiments thereof, it should be understood that variations and modifications can be effected within the spirit and scope of the invention as described hereinbefore and as defined in the appended claims.

What is claimed is:

1. A method of treating an aluminum base metal having at least one alloying element alloyed therewith to lower the recrystallization temperature thereof comprising:

a. casting the metal in a moving mold formed by a groove in the periphery of a casting wheel and an endless belt lying adjacent the groove along a portion of the periphery of the wheel to form a continuous aluminum bar having intermetallic compound precipitates formed therein;

b. hot-working the bar substantially immediately after casting while the bar is in substantially that condition as cast by rolling the bar in a rolling mill having closed roll passes to obtain a continuous metal rod having a subgrain structure of given cell size and to break-up and disperse said precipitates therethrough, the bar exiting the rolling mill at a temperature of from about 500° F to about 850° F; and c. cooling the rod from the elevated rolling temperature to about 400° F in a minimum of 30 seconds at a rate selected to achieve an increase in said cell size by the process of static recovery and from about 400° F to ambient temperature at a maximum cooling rate of 300° F per minute selected to permit further precipitation of said intermetallic compounds and coalescence into large coarse precipitate particles thereby lowering the recrystallization temperature of the metal.

2. The method of claim 1, step (c) wherein the rod is at a temperature of from about 550° F to about 750° F as it exits the rolling mill.

3. The method of claim 1, step (c) wherein the rod is cooled from the elevated rolling temperature to ambient temperature in the absence of application of any quenching medium.

4. The method of claim 1, wherein said step of cooling the rod from the elevated rolling temperature to ambient temperature is accomplished by application of a cooling solution.

5. The method of claim 1 wherein the aluminum base metal is electrical conductor grade aluminum.

6. The method of claim 1 including the step, prior to casting the metal into a continuous bar, of alloying aluminum having associated trace elements with at least one alloying element selected from the group consisting of iron, cobalt, nickel, silicon, copper, magnesium and rare earths.

7. The method of claim 6 wherein aluminum is alloyed with from about 0.01 to about 1.20 weight percent iron and up to about 1.00 weight percent silicon.

8. The method of claim 7 wherein aluminum is alloyed with from about 0.30 to about 0.95 weight percent iron and from about 0.01 to about 0.15 weight percent silicon.

9. The method of claim 6 wherein aluminum is alloyed with from about 0.20 to about 1.60 weight percent cobalt and from about 0.30 to about 1.30 weight percent iron.

10. The method of claim 6 wherein aluminum is alloyed with from about 0.20 to about 1.60 weight percent nickel and from about 0.30 to about 1.30 weight percent iron.

11. The method of claim 6 wherein aluminum is alloyed with from about 0.55 to about 0.95 weight percent nickel.

12. The method of claim 1 further including the subsequent steps of drawing the cooled rod with no preliminary or intermediate anneals to form wire; and simultaneously annealing the wire and enameling the wire with an electrolytic resin at a temperature of below about 500° F.

13. The method of claim 1 further including the subsequent steps of applying a thin annular sheath of cladding material around the entire periphery of said rod, and bonding said sheath to said rod to produce a clad rod suitable for subsequent drawing into wire without subsequent heat treating or metal cutting operations on said clad rod.

14. The method of claim 13 wherein said cladding material is tin.

15. The method of claim 13 wherein said cladding material is copper.

16. The method of claim 13 wherein the maximum temperature of the rod during the bonding step is less than about 500° F.

17. The method of claim 13 including the step of thereafter drawing the clad rod with no preliminary or intermediate anneals to form wire.

18. The method of claim 17 including the step of finally annealing or partially annealing the wire at a temperature of below about 500° F.

* * * * *